US005221371A

United States Patent [19]

Miller

[11] Patent Number: 5,221,371

[45] Date of Patent: Jun. 22, 1993

[54] NON-TOXIC CORROSION RESISTANT CONVERSION COATING FOR ALUMINUM AND ALUMINUM ALLOYS AND THE PROCESS FOR MAKING THE SAME

[75] Inventor: Robert N. Miller, Acworth, Ga.

[73] Assignee: Lockheed Corporation, Calabasas, Calif.

[21] Appl. No.: 754,136

[22] Filed: Sep. 3, 1991

[51] Int. Cl.[5] ..... C23C 22/06

[52] U.S. Cl. ..... 148/273; 148/273

[58] Field of Search ..... 148/273, 215

[56] References Cited

U.S. PATENT DOCUMENTS 2,512,493 6/1950 Gide ..... 148/273

4,610,732 9/1986 Sasalic ..... 148/273

*Primary Examiner*—Sam Silverberg

*Attorney, Agent, or Firm*—Eric R. Katz

[57] ABSTRACT

A non-toxic corrosion resistant conversion coating for aluminum is formed by a process which includes subjecting the aluminum to an acidic aqueous solution containing potassium permanganate and cerous chloride, alone or in combination with strontium chloride. The corrosion resistance is improved by a subsequent treatment in an alkaline solution containing molybdate, nitrite and metasilicate ions. The corrosion resistant is further improved by treating the coated surface with an alcoholic solution containing glycidoxy(epoxy)-polyfunctionalmethoxysilane, alone or in combination with phenyltrimethoxysilane. The coating thus produced is a mixture of oxides and hydroxides of cerium strontium and aluminum. These oxides and hydroxides may also be intermixed with molybdate silicate and nitrite ions. In the most corrosion resistant form the mixture further includes a silane overcoat.

12 Claims, No Drawings

NON-TOXIC CORROSION RESISTANT CONVERSION COATING FOR ALUMINUM AND ALUMINUM ALLOYS AND THE PROCESS FOR MAKING THE SAME

TECHNICAL FIELD

This invention relates to conversion coatings for the corrosion protection of aluminum and aluminum alloys. More specifically, a process is proposed wherein a protective coating or film is produced on the surface of aluminum or aluminum alloys by a chemical reaction with the aluminum, which process does not include toxic elements such as chromates. The coating herein produced is particularly designed and adapted for use in military applications wherein stringent test requirements, as set forth in Military Specification, MIL-C-5541C, must be met.

BACKGROUND OF THE INVENTION

Conversion coatings are employed on metals, notably aluminum and aluminum alloys whereby the metal surface reacts with a solution to convert to a corrosion protective film. Often, but not always, this protective film serves as a primer which may be top-coated with a paint for appearance purposes and also to enhance corrosion resistance. Heretofore, conversion coatings have employed chromates where maximum corrosion protection is desired or required. The most widely used chromate treatment for aluminum is the chromate-containing Alodine 1200 process (Alodine 1200 is manufactured and sold by Amchem Products, Inc., Ambler, Pennsylvania). The Alodine process, however, puts chromates into waste water which are either not permitted or are severely restricted by the Environmental Protection Agency of the United States Government. Illustrative of such chromate uses in protective coatings are the U.S. Pat. Nos. 4,146,410 to Reinhold and 4,541,304 to Batiuk and the prior art references cited therein.

Where efforts have been made to avoid the use of chromates in conversion coatings special treatments are required which in most cases are either objectionable and unacceptable or do not provide the required or desired degree of corrosion resistance. Illustrative of such non-chromate coatings are the following U.S. Pat. Nos. 3,672,821 issued to Schlussler and 3,964,936 issued to Das. Also and more closely related to the present invention is the Great Britain patent 2 195 338A issued to Sanchem, Inc. and Paper No. 197 from CORROSION 86, entitled "Cationic Film Forming Inhibitors for the Protection of 7025 Aluminum Alloy Against Corrosion in Aqueous Chloride Solution" by Arnott, Hinton and Ryan presented at the annual meeting of the National Association of Corrosion Engineers, March 17–21, 1986.

The Sanchem patent proposes a non-toxic conversion coating process employing relatively high alkaline solutions (pH 7 to 14) and is limited to in-house or laboratory use because of the elevated temperatures (at least 150° F.) required. Moreover, the coating produced by Sanchem has limited corrosion inhibition, not acceptable in severe aqueous saline environments, notably MIL-C-5541C referred to above.

The Arnott et al. article recognizes the use of cerous chloride in lieu of a chromate to improve corrosion inhibition of aluminum. However, to be effective, exposure of the aluminum specimens to the cerous chloride is required for a prolonged time, on the order of 65 hours, which is unacceptable in production use. Moreover, the coated aluminum still fails to meet the corrosion protection requirements in severe aqueous saline environments.

Separately and apart from the foregoing, present day conversion coatings as illustrated by the above cited patents and publication, are readily wetted by moisture. It is well known that corrosion resistance of coatings is not as good as it could be if moisture were repelled, i.e, the coating were hydrophobic. At the same time there is a problem in making surfaces hydrophobic. Paint topcoats will not adhere to surfaces which are highly hydrophobic, i.e., surfaces which have too low a surface energy. Surfaces readily wetted by water have energies greater than 65 dynes/cm. while surfaces such as polyethylene and teflon which have surface energies of approximately 25 dynes/cm. are not readily wetted by moisture or solvents. Consequently it is difficult to get adequate paint adherence on surfaces having low energy. However, it was demonstrated that the standard epoxy-polyamide paint (MIL-P-23377) used on Air Force and Navy aircraft will adhere well to surfaces having an energy at or above 40 dynes/cm. The results of this study are shown in the following Table.

TABLE I

CRITICAL SURFACE TENSION OF WETTING OF CLEANED PANELS (dynes/cm)

| Cleaning Method* | 7075-T6 Bare Aluminum | 7075-T6 Clad Aluminum | 7178-T6 Bare Aluminum | PAINT ADHESION** |
|---|---|---|---|---|
| 1 | 55.4 | 63.5 | 56.7 | Passed |
| 2 | 59.5 | 68.8 | 58.0 | Passed |
| 3 | 29.4 | 27.5 | 13.0 | Failed |
| 4 | 13.0 | 36.2 | 13.0 | Failed |
| 5 | 32.0 | 36.2 | 36.2 | Marginal |
| 6 | 16.0 | 16.0 | 32.0 | Failed |
| 7 | 49.2 | 54.0 | 55.4 | Passed |
| 8 | 27.5 | 32.0 | 40.0 | Passed |

TABLE I-continued

| CRITICAL SURFACE TENSION OF WETTING OF CLEANED PANELS (dynes/cm) | | | | |
|---|---|---|---|---|
| Cleaning Method* | 7075-T6 Bare Aluminum | 7075-T6 Clad Aluminum | 7178-T6 Bare Aluminum | PAINT ADHESION** |
| 9 | 49.2 | 58.0 | 62.0 | Passed |

* Method 1 — This method consisted of brushing a coat of Turco 4906 (a product manufactured and sold by Turco Products Division of Purex Corp., Wilmington, California) on the panels, rinsing with water, neutralizing with 5% by weight aqueous $NaHCO_3$, and again rinsing with water. The cleaner remained on the panels for 15 minutes before the first rinse.

Method 2 — A layer of Chemidize 727C (a product manufactured and sold by Hughson Chemicals, Erie, Pennsylvania) 5 to 10 mils thick, was applied to the contaminated panels and rinsed with water after 15 minutes.

Method 3 — The panels were wet-scrubbed with SCOTCHBRITE No. 447 Type A pads (a product manufactured and sold by 3M, Inc., Minneapolis, Minnesota) wetted with methyl ethyl ketone with moderate pressure and just long enough to abrade the surface to brightness. The loose powder formed by the scrubbing operation was removed with paper towels wet with methyl ethyl ketone.

Method 4 — The panels were soaked for 15 minutes in a solution of Clarkson AQS Emulsion (a production manufactured and sold by Clarkson Chemical Company, Palo Alto, California) diluted to the manufacturer's specifications, and then rinsed with water.

Method 5 — The substrates were solvent-cleaned. Texize 882 (a product manufactured and sold by Tec Chemical Co., Monterey Park, California) was applied for 15 minutes; the surfaces were then rinsed with water and dried.

Method 6 — The panels were wiped with paper towels wet with methyl ethyl ketone solvent. They were then scrubbed to brightness with SCOTCHBRITE No. 447 Type A pads wet with water, given a water rinse, and a final methyl ethyl ketone solvent wipe.

Method 7 — The substrates without surface treatments were solvent-cleaned (methyl ethyl ketone). Texize 882 emulsion cleaner was applied for 15 minutes, rinsed with water, dried, and then coated with Spray Coating 13 (a product manufactured by Spraylat Ltd., Mt. Vernon, New York) to protect the surfaces from contamination.

Method 8 — Texize 820 (a product manufactured and sold by Tec Chemical Co. Monterey Park, California) diluted according to the manufacturer's directions, was applied with a brush and permitted to remain on the panels for 15 minutes. It was then rinsed off with water at room temperature.

Method 9 — The panels were cleaned by applying a layer of Turco 4906, 5 to 10 mils thick, and rinsing with water. They were then treated with a solution containing 5% $Na_3PO_4$ and given a final water rinse.

** Tests were conducted with SCRATCHMASTER (Tradename of a paint adhesion tester of Dupont Chemical Co., Wilmington, Delaware). The SCRATCHMASTER measures paint adhesion by moving a blade over a painted surface with a gradually increasing load. The load, in kilograms, required to scrape through the paint to base metal is a quantitative measure of the paint adhesion.

DISCLOSURE OF THE INVENTION

Accordingly, the present invention is directed to a corrosion resistant chemical conversion coating on aluminum and aluminum alloys and the process of producing same in which toxic chromates are not required. At the same time the instant coating is resistant to wetting and the penetration of moisture but has a controlled surface energy of approximately 40 dynes/cm. which is low enough to repel moisture while high enough to permit wetting and good adhesion by solvent-based aircraft paint systems. Also, the corrosion resistant chemical conversion coating in accordance with one aspect of this invention is capable of meeting the extreme requirements of MIL-C-5541C for aluminum and aluminum alloy surfaces by withstanding exposure to a salt fog for 336 hours.

The foregoing accomplishments of the coating herein proposed may be effected without special treatments such as prolonged exposure to solutions. The instant coating process may be completed in some applications under ambient temperature conditions in a simple rinsing operation of only minutes duration.

More specifically, the corrosion resistant chemical conversion coating proposed by one form of this invention comprises the forming on aluminum surfaces of a mixture of the oxides and hydroxides of cerium, strontium and aluminum. Such a mixture is produced by subjecting the aluminum to an acidic aqueous solution containing cerous chloride and potassium permanganate alone or with strontium chloride.

In another form of the invention a similar coating is produced on aluminum surfaces which comprises a mixture of molybdate, silicate and nitrite ions intermixed with the oxides and hydroxides of aluminum. This mixture is produced by subjecting the aluminum to an alkaline aqueous solution containing sodium molybdate, sodium nitrite and sodium metasilicate.

In both of the foregoing cases corrosion resistance is further improved by an added layer or overcoat produced by treating the coated aluminum surface with an alcoholic solution containing glycidoxy(epoxy)-polyfunctionalmethoxysilane alone or in combination with phenyltrimethoxysilane. The particular alcohol used in these solutions was ethyl alcohol although other alcohols, such as for example isopropyl or methyl are known to be equally effective as solvents for the silanes.

The above and other objects and advantages of the present invention will become more apparent from the following detailed description included in the best mode for carrying out the invention.

BEST MODE FOR CARRYING OUT THE INVENTION

Generally, the present invention is practiced in the following sequence of operations. Initially, the aluminum or aluminum alloy is prepared for treatment in accordance with the invention by standard techniques of degreasing and deoxidizing known to and practiced routinely by persons skilled in the art. For example, the aluminum or aluminum alloy is degreased by putting it in a hot (about 140° F.) detergent solution; then rinsed thoroughly with water at ambient temperature; and finally deoxidized completely by manually abrading its surface with a carborundum pad or by immersion in a standard, commercially available deoxidizing solution and rinsed thoroughly with water at ambient temperature.

Having thus prepared the aluminum or aluminum alloy specimen, four basic solutions and their variations are prepared as follows:

Solution A comprises:

50 ml $H_2O$
2 g $CeCl_3$
1 g $SrCl_2$
0.2 g $KMnO_4$

Variations Comprise:

| A-1 | A-2 | A-3 | A-4 | A-5 | A-6 |
|---|---|---|---|---|---|
| 50 ml $H_2O$ | 50 ml $H_2O$ | 50 ml $H_2O$ | 50 ml $H_2O$ | 50 ml $H_2O$ | 50 ml $H_2O$ |
| 4 g $CeCl_3$ | 5 g $CeCl_3$ | 5 g $CeCl_3$ | 2 g $CeCl_3$ | 1 g $CeCl_3$ | 5 g $CeCl_3$ |
| 0.2 g $KMnO_4$ | 0.2 g $KMnO_4$ | 0.2 g $KMnO_4$ | 1 g $KMnO_4$ | 0.2 g $KMnO_4$ | 15 ml NaOH(1.6 g/liter) |
| | 15 ml NaOH(1.6 g/liter) | | | | 10 ml $H_2O_2$ |

Solution A and all of its variations A-1 through A-6 are acidic and have pH values ranging from 2 to 5.

| Solution B Comprises: |
|---|
| 500 ml $H_2O$ |
| 5 g $Na_2MoO_4$ |
| 5 g $NaNO_2$ |
| 3 g $Na_2SiO_3$ |
| Variations Comprise: |
| B-1 |
| 500 ml $H_2O$ |
| 5 g $Na_2MoO_4$ |
| 5 g $NaNO_2$ |
| 5 g $NaSiO_3$ |
| Solution C Comprises: |
| 90 ml Ethyl Alcohol (EtOH) |
| 5 ml Phenyltrimethoxysilane (X1-6124, Dow Corning) |
| 5 ml Glycidoxy(epoxy)polyfunctionalmethoxysilane (Z-6040, Dow Corning) |
| Solution D Comprises: |
| 90 ml EtOH |
| 10 ml Z-6040 |

In order to meet the requirements of MIL-C-5541C three of the above solutions must be employed. This is done in the following manner:

1. The specimen is immersed in Solution A for about 4 minutes at room or ambient temperature and then thoroughly rinsed in water at ambient temperature.
2. The specimen is then immersed in Solution B at about 200° F. for approximately 15 minutes and then thoroughly rinsed in water at ambient temperature.
3. The specimen is then swabbed with Solution C or with Solution D and allowed to dry at ambient temperature.

Thus, a coating of multiple layers is produced on the surfaces of the specimen to give it maximum corrosion protection.

The reaction of Solution A with the surface of the aluminum or aluminum alloy produces a conversion coating comprised of a mixture of the oxides and hydroxides of cerium, strontium and aluminum. The variations of Solution A, i.e., A-1, A-2, A-3, A-4, A-5 and A-6 do not contain strontium and, therefore, the reaction these variations with the aluminum or aluminum alloy produces no strontium oxide or hydroxide.

The reaction of Solution B or variation B-1 with the aluminum or aluminum alloy produces a coating comprised of a mixture of molybdate, silicate and nitrite ions intermixed with the oxides and hydroxides of aluminum.

The reaction of Solution B or its variation B-1 with the coating produced by Solution A produces a layer containing cerous molybdate, and cerous silicate mixed with the oxides and hydroxides of aluminum.

Solution C, when applied following the use of Solution A or B or any of their variations as above, produces an additional surface layer containing a cross-linked silane structure resulting from the reaction between atmospheric moisture and the mixture of phenyltrimethoxysilane and glycidoxy(epoxy)polyfunctionalmethoxysilane.

Solution D, when applied following the use of Solution A or B or any of their variations as above, produces an additional surface layer comprised of a cross-linked reaction product of atmospheric moisture and glycidoxy(epoxy)polyfunctionalmethoxysilane.

For less stringent requirements than those of MIL-C-5541C and for repairs to aluminum and aluminum alloy surfaces in the field, in step 1 above, Solution A or any of its variations A-1, A-2, A-3, A-4 or A-5 may be applied by swabbing and rinsing thoroughly after about 4 minutes and step 2 as stated above may be omitted. Treatment of the specimen with only Solution A and C or D will result in corrosion protection for approximately 176 hours of exposure, as opposed to 336 hours when three Solutions A, B and C or D are used. The results of separate corrosion and paint adhesion tests demonstrated that the use of X1-6124 to produce a hydrophobic surface on the conversion coating will increase the corrosion resistance but will decrease paint adhesion. A silane designed to produce chemical bonding between aluminum surfaces and paint films, viz. (Z-6040) produced good paint adhesion but only fair corrosion resistance.

As shown in Table II below, it was determined that the desired balance of corrosion resistance and paint adhesion is obtained by using a solution containing various proportions of Xl-6124 and Z-6040 or Z-6040 alone with 90% ethanol. The panels were then primed with MIL-P-23377 epoxy polyamide paint and top coated with white polyurethane. They were immersed in distilled water for 24 hours and subjected to the Wet Tape Paint Adhesion Test.

The Wet Tape Paint Adhesion Test is conducted by immersing painted panels for 24 hours in distilled water. Immediately after the panels are removed from the water they are dried by wiping with a paper towel and two parallel scribe marks, one inch apart, are cut in the paint.

A strip of 3M No. 250 masking tape is then applied to the painted surface perpendicular to the scribe marks. It is rolled firmly with a roller and the tape is then removed in one rapid motion. The test is failed if paint is removed from the panel. TABLE II summarizes the results of the tests.

TABLE II

| | SILANE FORMULATION | | | | |
|---|---|---|---|---|---|
| ALLOY | 90% Ethanol 10% Z-6040 | 90% Ethanol 5% Z-6040 5% X1-6124 | 90% Ethanol 3.3% Z-6040 6.7% X1-6124 | 90% Ethanol 1.7% Z-6040 8.3% X1-6124 | 90% Ethanol 10% X1-6124 |
| 7075-T6 Aluminum | Passed | Passed | Passed | Passed | Failed |
| 2024-T3 Aluminum | Passed | Passed | Passed | Passed | Failed |

The present invention may be further understood from the tests that were performed as described in the EXAMPLES below. In each case preliminary to the tests the aluminum or aluminum alloy specimen was prepared following standard practices as follows:

1. The specimen was degreased by being placed in a hot (about 140° F.) alkaline cleaner for 10–15 minutes and then rinsed thoroughly in water at room or ambient temperature.
2. The specimen was then deoxidized completely, i.e., in the case of small pieces, it was abraded with SCOTCHBRITE (tradename of a product manufactured and sold by 3M Inc., Minneapolis, Minnesota) and in the case of larger pieces, it was immersed in an acid chemical deoxidizer (Turco SMUTGO NC-B, which is a tradename for such a product manufactured and sold by Turco Products Division of Purex Corporation, Wilmington, California) for about 15–25 minutes at room or ambient temperature, followed by a thorough rinse in water at room or ambient temperature.

The following EXAMPLES illustrate the effectiveness of the various treatments and combination of treatments in minimizing corrosion of aluminum alloys exposed to aqueous saline solution while also providing acceptable paint adhesion. Two of the alloys used in the tests were 7075-T6 aluminum and 2024-T3 aluminum. These alloys contain 2% and 4% copper, respectively, and are especially susceptible to corrosion in aqueous saline solutions or environments.

The tests used to determine corrosion resistance were potentiodynamic polarization tests and exposure to 5% NaCl salt fog.

POTENTIOSTATIC POLARIZATION TEST

The 7075-T6 aluminum specimens were ¾" in diameter and 1" long. They were wet-polished with 600 grit silicon carbide paper prior to being treated by the chemical conversion coating procedures. The corrosion resistances of the coatings were evaluated with a Princeton Applied Research Model 350 Corrosion Measurement Unit. In this test the specimen was immersed in 0.35% NaCl solution and functioned as an electrode. A carbon electrode was also immersed in the solution. The current flowing between the electrodes was plotted while a varying voltage (−1.0 to −0.5 volts) was applied between the electrodes. From the resulting Voltage vs Current plots it was possible to calculate the corrosion rate of the treated aluminum in the solution when no current was flowing in the circuit. The corrosion rate is expressed in mils per year.

SALT FOG TEST

The 7075-T6 and 2024-T3 aluminum panels, 3"×9"×0.06" were treated with the conversion coating procedure described in the following EXAMPLES and placed in a 5% NaCl salt fog environmental chamber maintained at a temperature of 94° F. The specimens were examined periodically for evidence of pitting and corrosion.

It should be noted that the specimens and panels in each of the EXAMPLES below were thoroughly rinsed after treatment in each solution.

EXAMPLE I

A 7075-T6 aluminum potentiostatic specimen was immersed for five minutes in Solution A at room temperature. The corrosion rate in 0.35% NaCl solution was 0.87 mils/year.

EXAMPLE II

This test illustrates the effectiveness of adding a silane as a final treatment to EXAMPLE I. A 7075T6 aluminum specimen was immersed for 5 minutes in Solution A and then swabbed with a solution containing:

60 ml EtOH
40 ml XI-6124

The corrosion rate in 0.35% NaCl solution was thereby reduced from 0.87 to 0.29 mils/year.

EXAMPLE III

A 7075-T6 aluminum specimen was immersed for 10 minutes in Solution B-1 at 200° F. The corrosion rate in 0.35% NaCl solution was 0.27 mils/year.

EXAMPLE IV

A 7075-T6 aluminum specimen was immersed for 10 minutes in Solution A-2 at room temperature. It was then immersed for 20 minutes in Solution B at 200° F. The corrosion rate in 0.35% NaCl solution was only 0.039 mils/year.

EXAMPLE V

Panels of 7075-T6, 2024-T3 and 6061-T6 aluminum were immersed for 10 minutes in Solution B at 200° F. They were then immersed for 5 minutes in a Solution A-3 at room temperature.

The panels were then placed in a salt fog chamber where they withstood 268 hours of exposure before they showed evidence of pitting and corrosion.

EXAMPLE VI

The corrosion resistance of treated panels is related to the thickness of the conversion coating. It was discovered that the coating thickness could be increased and the corrosion resistance improved by immersing 2024-T3 and 7075-T6 aluminum panels in Solution B at 200° F. for 10 minutes (Step 1), in Solution A-3 at room temperature for 5 minutes (Step 2), and back into Solution B at 200° F. for 10 minutes (Step 3).

Both panels were in excellent condition after 168 hours of salt fog exposure. At the end of 336 hours the 2024-T3 panel was still in excellent condition but the 7075-T6 panel was beginning to corrode. It was noted that the top layer of the conversion coating was providing galvanic protection to the layer beneath.

The durability of this coating seems to be due to a chemical reaction between the coating produced by Steps 1 and 2 and the subsequent reaction thereon of Solution B as used in Step 3. The solution used in Step 2, namely, Solution A-3 is acidic and has a pH of 2.30. This creates an acidic conversion layer on the surface of the test specimens. Solution B used in Step 3 is strongly alkaline with a pH of 11.61. Thus, when the specimen with the acidic coating is immersed in the alkaline solution at the beginning of Step 3 there is a neutralization reaction between the acidic and alkaline components. Many small bubbles are emitted for about 30 seconds and one of the products of the reaction is a corrosion resistant layer on the surface of the metal.

The total conversion coating is composed of an initial silver-colored layer which is formed in Step 1, and a gold colored surface layer created by Steps 2 and 3. The surface layer is anodic to the layer beneath and protects it galvanically when the specimen is exposed to salt water.

EXAMPLE VII

A 7075-T6 aluminum specimen was immersed in Solution B at 200° F. for 10 minutes. It was then immersed for 5 minutes in Solution A-2 at room temperature. The specimen was then immersed for another 10 minutes in Solution B at 200° F. The corrosion rate in 0.35% NaCl solution was 0.099 mils/year.

EXAMPLE VIII

In order to determine which silane or combination of silanes is most effective in obtaining optimum surface energy (40 dynes/cm), panels of 7075-T6 aluminum were immersed for 3 minutes in Solution A-4 at room temperature. Individual panels were then swabbed with a 10% silane- 90% ethyl alcohol solution, each containing a different silane. The surface energies of the treated panels were then determined by measuring the diameter of 5-microliter drops of distilled water applied to the surface of the panels. The drop diameters were converted to surface energy units in dynes/cm. Table III summarizes the results of the tests.

TABLE III

SURFACE ENERGIES OF TREATED ALUMINUM PANELS

| Silane | Surface Energy (Dynes/Cm) |
|---|---|
| Octyltriethoxysilane (A-137 Union Carbide) | 40 |
| Isobutylmethoxysilane (Q-2306 Dow Corning) | 24 |
| Aminoethylaminopropysilane (Z-6020 Dow Corning) | 67 |
| Methyltrimethoxysilane (Z-6070 Dow Corning) | 24 |
| Phenyltrimethoxysilane (X1-6124 Dow Corning) | 32 |
| Glycidoxy(epoxy)functionalmethoxysilane (Z-6040 Dow Corning) | 40 |

Since the result of previous tests (TABLE I) showed the optimum surface energy to be approximately 40 dynes/cm, Wet Tape Paint Adhesion Tests were conducted on the A-137, Xl-6124 and Z-6040 panels.

Panels which were coated with the A-137 and with the Xl-6124 and then painted with epoxy polyamide primer and white polyurethane topcoat failed the Wet Tape Paint Adhesion Test.

Panels which were coated with the Z-6040 and then painted with epoxy polyamide primer and white polyurethane topcoat passed the Wet Tape Paint Adhesion Test.

EXAMPLE IX

Panels of 2024-T3 and 7075-T6 aluminum were immersed for 10 minutes in Solution B at 200° F., then 4 minutes in Solution A at room temperature and an additional 10 minutes in Solution B at 200° F. One set of panels was swabbed with Solution C. A second set of panels was swabbed with Solution D. All of the panels were coated on one side only with epoxy polyamide primer and a white polyurethane topcoat. All panels passed the Wet Tape Adhesion Test.

The same panels were employed to test for corrosion resistance by placing them in the salt fog chamber with the unpainted side up. At the end of 336 hours all panels were still in good condition and just beginning to show traces of corrosion.

EXAMPLE X

A 7075-T6 aluminum specimen was immersed for 10 minutes in Solution B at 200° F.

A surface film was produced which, in 0.35% NaCl solution, had a galvanic potential of −0.653 volts with respect to a calomel reference electrode.

The specimen was then immersed in Solution A at room temperature for 5 minutes and again immersed in Solution B at 200° F. for 10 minutes. These steps produced an additional protective layer which had a galvanic potential of −0.972 volts, making it anodic to the initial layer.

In 0.35% NaCl solution, the treated 7075 T-6 aluminum specimen had a corrosion rate of only 0.099 mils/-year.

The specimen did not corrode after 168 hours of immersion in 3.5% NaCl solution (ten times the usual salt concentration). It was noted that the gold-colored surface layer dissolved in spots and exposed the layer of aluminum oxide and aluminum hydroxide which was formed in the first step of the process. Thus the surface layer acted like the zinc layer on galvanized steel. When exposed to salt water it sacrificially dissolved and gave the layer underneath galvanic protection.

The net result of the total process is a chemical conversion coating which gives dual protection to aluminum. First, it forms a barrier layer which protects it from the environment and, second, if the barrier layer is penetrated in spots it prevents exposed metal from corroding by sacrificially dissolving and making the exposed spots cathodic.

EXAMPLE XI

A 7075-T6 aluminum specimen was immersed for 5 minutes in a Solution A-6 at room temperature. The corrosion rate in 0.35% NaCl solution was 0.073 mils/-year. This test shows that hydrogen peroxide ($H_2O_2$) may be substituted for potassium permanganate ($KMnO_4$) as the oxidizing agent in the conversion coating reaction.

EXAMPLE XII

This test illustrates the fact that variations of the Solutions A and B, may be used in any order to obtain a corrosion resistant conversion coating on aluminum. A 7075-T6 aluminum specimen was immersed for 10 minutes in Solution A-5 at room temperature. It was then immersed for 20 minutes in a Solution B at 200° F. The corrosion rate in 0.35% NaCl solution was 0.39 mils/year.

EXAMPLE XIII

Three combinations of treatments resulted in conversion coatings which resisted salt fog exposure for 336 hours and also passed the Wet Tape Paint Adhesion Test.

1. Panels of 2024-T3 and 7075-T6 aluminum were immersed in Solution A at room temperature for 4 minutes, then in Solution B at 200° F. for 20 minutes, and then swabbed with Solution C.

2. Panels of 2024-T3 and 7075-T6 aluminum were immersed in Solution B at 200° F. for 10 minutes, then in Solution A at room temperature for 4 minutes, again in Solution B at 200° F. for 10 minutes, and then swabbed with Solution C.

3. Panels of 2024-T3 and 7075-T6 were treated as in 2 above except Solution D was substituted for Solution C in the final swabbing step.

While the invention has been hereinabove described with reference to preferred embodiments thereof, it will be understood by those skilled in the art that various alterations may be made therein without departing from the spirit and scope of the invention as covered by the appended claims.

I claim:

1. A process for producing a corrosion resistant chemical conversion coating on aluminum and aluminum alloys comprising subjecting a cleaned, degreased and deoxidized aluminum to an aqueous solution containing cerous chloride and potassium permanganate at ambient temperature whereby an acidic condition is created by the hydrolysis of the cerous chloride which reacts with said deoxidized aluminum.

2. The process of claim 1 wherein the acidic aqueous solution created as aforesaid further contains strontium chloride.

3. The process of claim 1 followed by a thorough rinsing of the treated aluminum aforesaid and then subjecting said treated aluminum to a solution containing ethyl alcohol, phentrimethyoxysilane and glycidoxy(epoxy)-polyvunctionalmethoxysilane whereby the coating thus produced on said aluminum combines water repellency with good paint adherence.

4. The process of claim 1 followed by a thorough rinsing of the treated aluminum aforesaid and then subjecting said treated aluminum to a solution containing ethyl alcohol and glycidoxy(epoxy)polyfunctionalmethoxysilane whereby the coating thus produced on said aluminum combines water repellency with good paint adherence.

5. The process of claim 1 followed by a thorough rinsing of the treated aluminum aforesaid and then subjecting said threated aluminum to a solution containing sodium molybdate, sodium nitrate and sodium metasilicate at about 200° F.

6. The process of claim 2 followed by a thorough rinsing of the treated aluminum aforesaid and then subjecting said treated aluminum to a solution containing ethyl alcohol, phenyltrimethoxysilane and glycidoxy(epoxy)polyfunctionalmethoxysilane whereby the coating thus produced on said aluminum combines water repellency with good paint adherence.

7. The process of claim 2 followed by a thorough rinsing of the treated aluminum aforesaid and then subjecting said treated aluminum to a solution containing ethyl alcohol and glycidoxy(epoxy)polyfunctionalmethoxysilane whereby the coating thus produced on said aluminum combines water repellency with good paint adherence.

8. The process of claim 2 followed by a thorough rinsing of said aluminum and then subjecting said aluminum to a solution containing sodium molybdate, sodium nitrite and sodium metasilicate.

9. The process of claim 1 followed by a thorough rinsing of said aluminum, then subjecting said aluminum to an alkaline aqueous solution containing sodium molybdate, sodium nitrite and sodium metasilicate and finally after a thorough rinsing said aluminum is subjected to a solution containing alcohol, phenyltrimethoxysilane and glycidoxy(epoxy)polyfunctionalmethoxysilane.

10. The process of claim 1 followed by a thorough rinsing of said aluminum, then subjecting said aluminum to an alkaline aqueous solution containing sodium molybdate, sodium nitrite and sodium metasilicate and finally after thoroughly rinsing said aluminum is subjected to a solution containing alcohol and glycidoxy(epoxy)polyfunctionalmethoxysilane.

11. The process of claim 2 followed by a thorough rinsing of said aluminum, then subjecting said aluminum to an alkaline aqueous solution containing sodium molybdate, sodium nitrite and sodium metasilicate and finally after a thorough rinsing said aluminum is subjected to a solution containing alcohol, phenytrimethoxysilane and glycidoxy(epoxy)polyfunctionalmethoxysilane.

12. The process of claim 2 followed by a through rinsing of said aluminum, then subjecting said aluminum to an alkaline aqueous solution containing sodium molybdate, sodium nitrite and sodium metasilicate and finally after thoroughly rinsing said aluminum is subjected to a solution containing alcohol and glycidoxy(epoxy)polyfunctionalmethoxysilane.

* * * * *